United States Patent [19]

Eck

[11] Patent Number: 4,592,225

[45] Date of Patent: Jun. 3, 1986

[54] VEHICLE REPAIR AND ALIGNMENT RACK

[75] Inventor: Leonard F. Eck, McPherson, Kans.

[73] Assignee: Hein-Werner Corporation, Waukesha, Wis.

[21] Appl. No.: 666,619

[22] Filed: Oct. 30, 1984

[51] Int. Cl.[4] ..... B21D 1/12

[52] U.S. Cl. ..... 72/457; 72/705; 187/8.71

[58] Field of Search ..... 72/705, 457; 254/3 R, 254/3 B, 90, 91; 187/8.41, 8.71, 8.72

[56] References Cited

U.S. PATENT DOCUMENTS

| | | |
|---|---|---|
| 2,013,785 | 9/1935 | Merrill . |
| 2,422,030 | 6/1947 | Merrill . |
| 2,717,020 | 9/1955 | Dobias . |
| 3,088,547 | 5/1963 | MacMillan . |
| 3,269,169 | 8/1966 | Latuff et al. . |
| 3,338,083 | 8/1967 | Eck . |
| 3,377,834 | 4/1968 | Latuff et al. . |
| 3,612,482 | 10/1971 | Eck . |
| 3,776,022 | 12/1973 | Lionello . |
| 3,835,693 | 9/1974 | Majersky . |
| 3,888,100 | 6/1975 | Chisum . |
| 4,070,899 | 1/1978 | Venalainen . |
| 4,138,876 | 2/1979 | Chisum . |
| 4,151,737 | 5/1979 | Specktor . |
| 4,247,966 | 2/1981 | Labbe . |
| 4,313,335 | 2/1982 | Eck . |
| 4,445,665 | 5/1984 | Cray ..... 254/90 |
| 4,447,042 | 5/1984 | Masui ..... 187/8.71 |

FOREIGN PATENT DOCUMENTS

| | | |
|---|---|---|
| 249933 | 2/1964 | Australia . |
| 1939618 | 2/1971 | Fed. Rep. of Germany ..... 187/8.71 |

OTHER PUBLICATIONS

Automotive Body Repair News, Jun. 1983 and Feb. 1984, Duz-Mor Jr. disclosure.

*Primary Examiner*—Lowell A. Larson

*Attorney, Agent, or Firm*—Litman, Day and McMahon

[57] ABSTRACT

A relatively lightweight, rigid, mobile work rack for correcting and aligning misshapen vehicle frame and body portions comprises spaced, parallel beam members and a central open space for unhindered access which extends the entire length of the rack. Front and rear pairs of legs individually or in combination between pairs swing up and down to selectively lower the entire rack or to tilt either the front or the rear end. The legs are mounted so that the entire rack fully lowers to rest upon the work shop floor and raises to a handy working height. A locking arrangement permits elevation of the rack at intermediate heights. Force applying structures are also selectively mountable to the work rack at various areas about its periphery and are braced for pulls to repair damaged vehicles.

5 Claims, 11 Drawing Figures

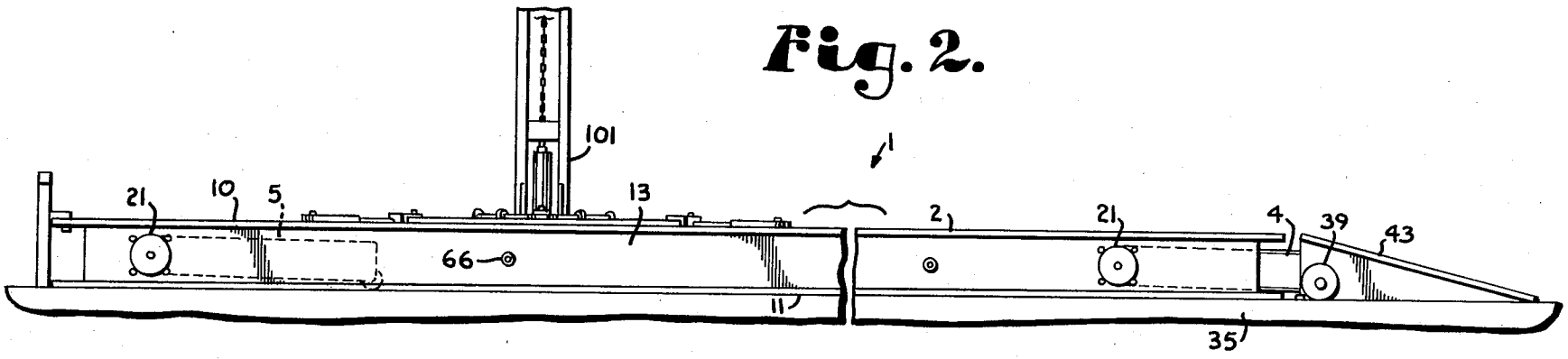
Fig. 2.
Fig. 3.
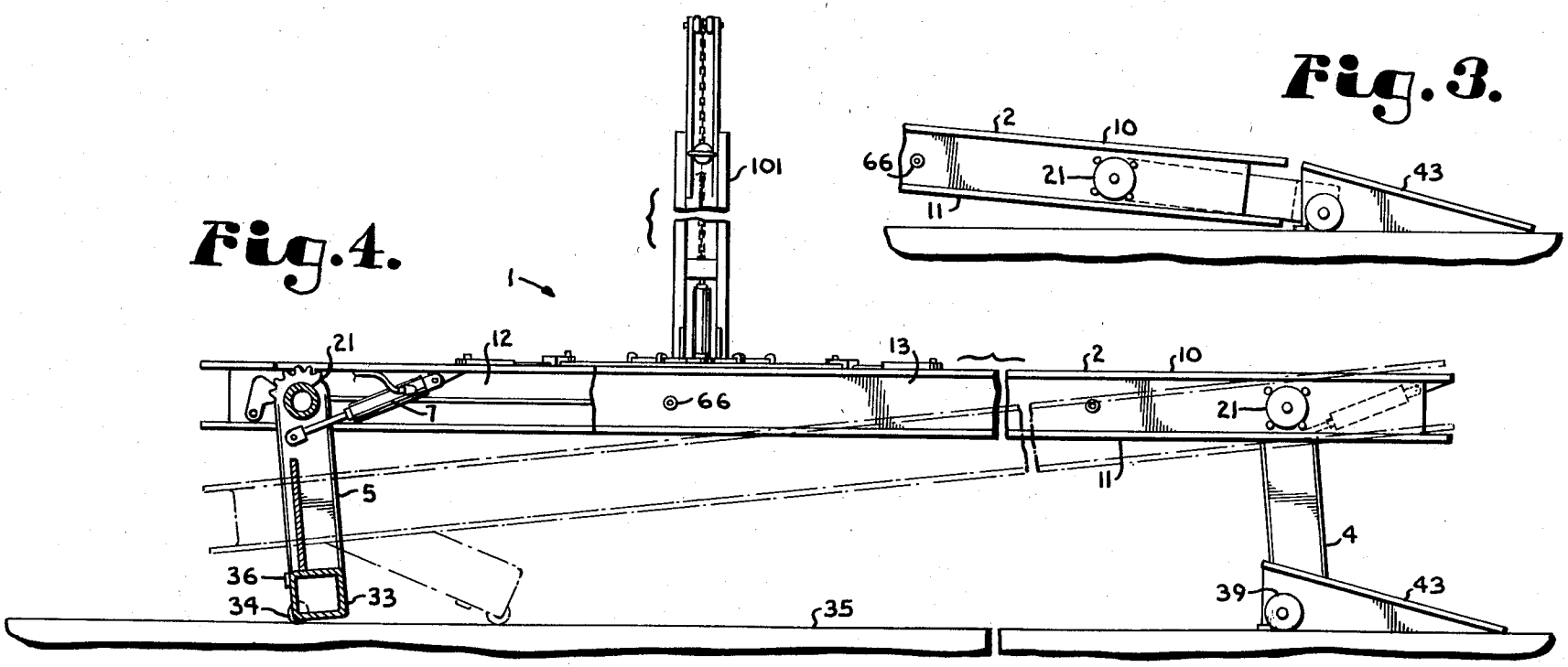
Fig. 4.

VEHICLE REPAIR AND ALIGNMENT RACK

BACKGROUND OF THE INVENTION

This invention relates to vehicle straightening and alignment structures and in particular to a work rack for use in aligning and straightening systems.

Work rack structures for correcting damaged, misaligned and misshapen vehicle frame and body parts often include a complex bridge work of vertical and horizontal beams which create obstructions that interfere with access to the vehicle and particularly to the vehicle underside. Such work racks are often associated with force applying units, power beams or the like which exert a force on a selected portion of the vehicle for correcting the damage. The force applying units are generally not easily movable or positionable relative to the work rack, making it difficult to exert a force in a desired direction. Moreover, the configuration of vehicle work racks typically requires that the vehicle be taken off of the rack, turned around and repostioned on the rack for corrections to the opposite end of the vehicle.

Applicant's U.S. Pat. No. 4,313,335 on a VEHICLE WORK RACK STRUCTURE was designed to alleviate some of these problems. The previous rack, however, is a particularly large and sturdily constructed arrangement intended for heavy-duty use and pulling severely bent frames of large, non-unibody cars and trucks. Although it can be used with the lighter unibody vehicles, it is indeed a larger and more sturdily constructed rack than necessary for these vehicles. The rack described in the '335 patent was also intended to present a central opening allowing substantially unhindered access to the underside of the vehicle. That rack, however, was generally constructed in the shape of an oval with closed front and rear ends so that the mechanic still had to crawl under a portion of the rack to gain access to the vehicle undercarriage. The present vehicle work rack provides advantages over the rack described in the '335 patent and other previously known work racks. The present work rack is relatively lightweight and mobile yet is rigidly constructed so that pulls of substantial force can be made. The rack is of a somewhat smaller scale than previous racks of applicant and is particularly designed to accommodate the new unibody "world" automobiles which do not have separate bodies and frames which require great amounts of strength to remove damage. The new rack is constructed for improved unhindered access to the underside of the vehicle and is open at both front and rear ends and with no fixed cross-bars at the working height to interfere with the mechanic's progress. The arrangement of legs and motive means for retraction and extension of the legs is arranged so that the rack moves downward to a position flat against the floor, a fully down position, so that the vehicle to be repaired can be easily driven onto the rack substantially at ground level, secured to the rack, and the rack then raised to a comfortable working height. Many previous racks are not capable of lowering to rest upon the floor surface and the vehicle must be driven on an upward incline to the rack; with over-zealous drivers there is the danger of driving the car off of the other side of rack and damaging the car further or even injuring other workers.

OBJECTS OF THE INVENTION

The objects of the present invention are: to provide a work rack which is relatively lightweight yet sufficiently rigid for the job; to provide such a work rack which is mobile and easily moved over a floor surface; to provide such a work rack which is not built into the floor so that the floor can be used for a multitude of purposes; to provide such a work rack which is positionable at intermediate elevations to adjust for different heights for different jobs; to provide such a work rack which is lowerable to rest flat upon the floor so that a vehicle can be driven onto the rack and then raised to a working height; to provide such a work rack which is tiltable fore and aft for complete access to the vehicle; to provide such a work rack having force applying structures such as power posts positioned around the perimeter of the work rack and adjustable in coverage to accommodate substantially all vehicles and areas of damage; to provide such a work rack in which the force applying structures may extend to virtually any part of the vehicle and to provide such a work rack which is efficient and sturdy in use, adaptable for a variety of uses, and well suited for its intended purpose.

Other objects and advantages of this invention will become apparent from the following description taken in conjunction with the accompanying drawings wherein are set forth, by way of illustration and example, certain embodiments of this invention.

DESCRIPTION OF THE DRAWINGS

FIG. 2 is an elevational view of the work rack showing same in a lowered position.

FIG. 3 is a fragmentary view of a portion of the work rack.

FIG. 4 is an elevational view of the work rack in a raised position.

DESCRIPTION OF THE PREFERRED EMBODIMENT

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
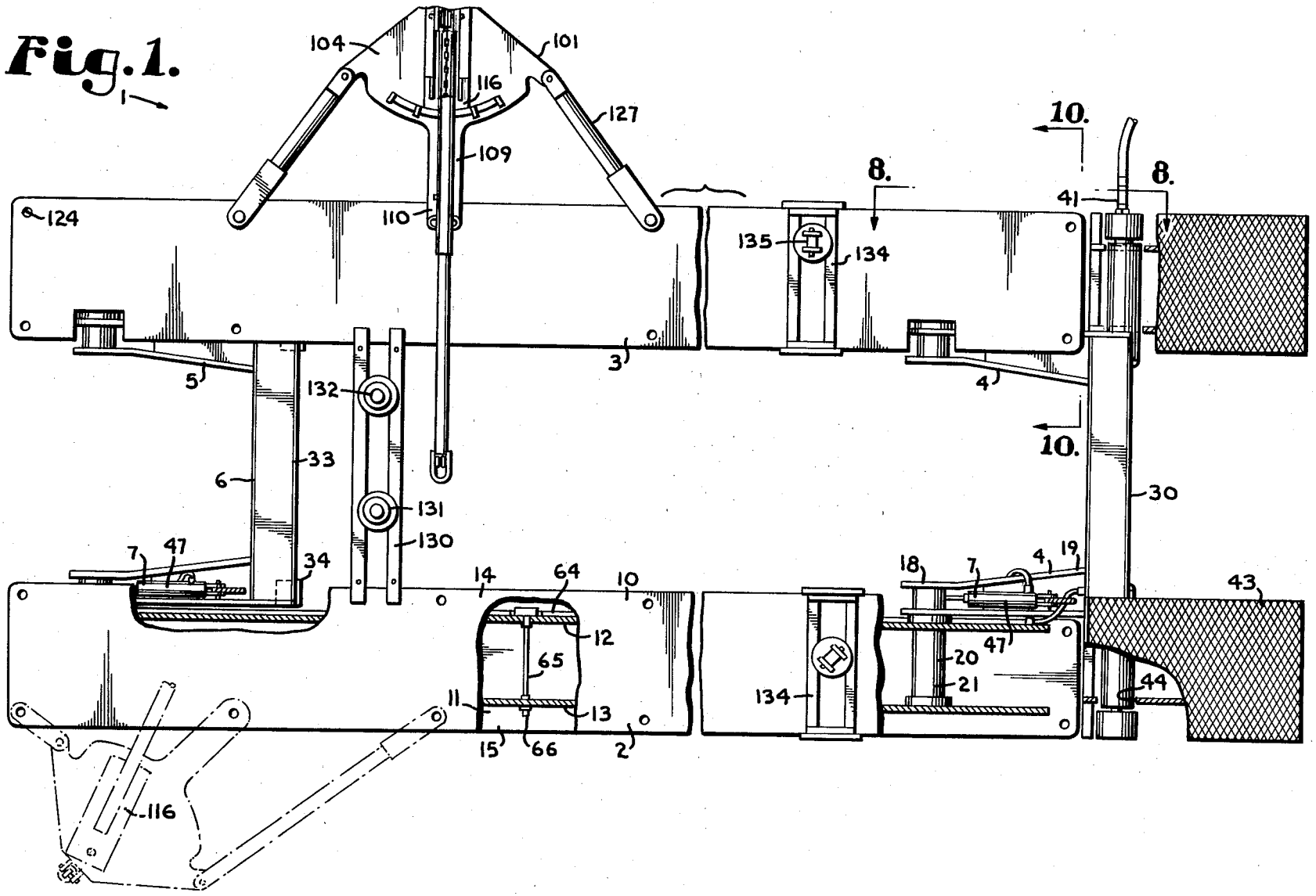
FIG. 1 is a fragmentary, plan view of a work rack embodying the present invention.
Figure 9:
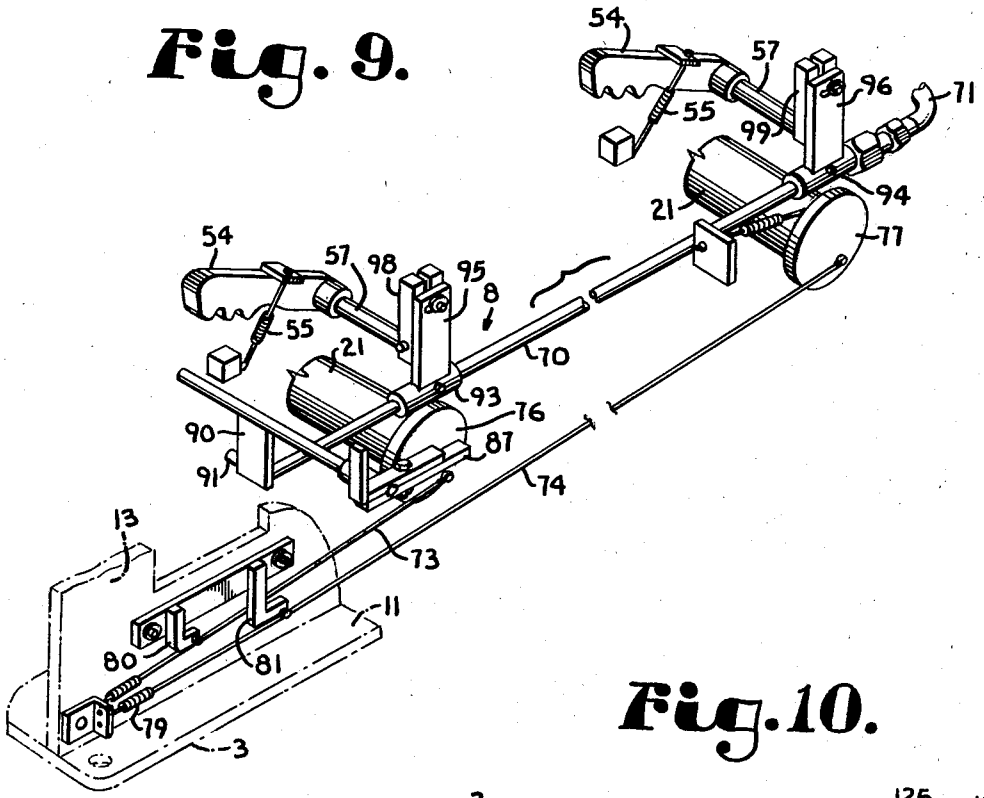
FIG. 9 is a fragmentary, perspective view of the controls assembly of the work rack taken along line 8—8, FIG. 1.

The reference numeral 1, FIGS. 1, 2 and 4 generally indicates a work rack embodying the present invention and used for correcting damaged, misshapen or misaligned vehicle frame and body parts. The work rack 1 includes spaced, parallel beam members 2 and 3 upon which the vehicle to be repaired is positioned. The rack 1 has front and rear pairs of legs 4 and 5 which are swingably mounted to the beam members 2 and 3 and with cross beams 6 affixed to the lower ends of the legs. Motive means 7 extend between the beam members 2 and 3 and the legs 4 and 5 and provide relative swinging of the legs. Control means 8, FIG. 9, are associated with the rack 1 for raising and lowering the rack and selectively tilting the front and rear ends of the rack.

Figure 10:
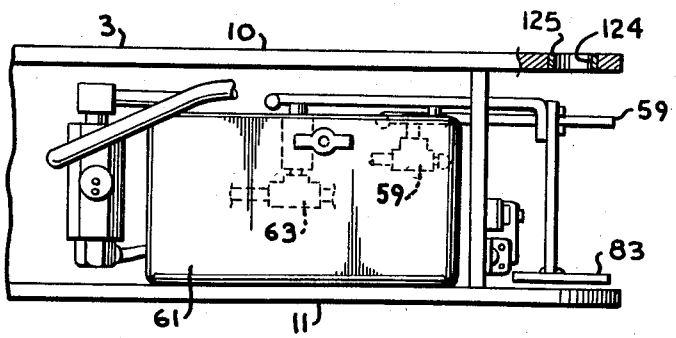
FIG. 10 is an enlarged fragmentary view showing details of the controls mechanism of the work rack taken along line 10—10, FIG. 1.

In the illustrated example, the beam members 2 and 3 are each of generally box beam construction and are long and straight. Top and bottom plates 10 and 11 and opposite inner and outer side plates 12 and 13 are formed together in a rectangular arrangement viewed when in cross section, FIG. 10. The inner and outer side plates 12 and 13 are set inwardly from the side margins of the top and bottom plates 10 and 11 and accordingly form inner and outer flanges 14 and 13, FIG. 1.

The beam members 2 and 3 are held together by the front and rear leg arrangements. The front leg arrangement, located generally at a place close to the control means 8, includes the spaced front legs 4. The arrangement of the front legs 4 is similar to that of the rear legs 5 and each of the front and rear legs will be described jointly with only the differences noted. Each of the legs includes an upper end 18 and a lower end 19 with the upper ends 18 rotatably mounted to the respective beam member 2 or 3 by a sturdy and massive joint 20. The illustrated joint 20 consists of a rotatable tube 21 connected at an end 22, FIG. 5, to a journal 23 and the beam outer side plate 13. The tube 21 extends through the inner side plate 12 and is maintained in position by a second journal 24. The tube 21 projects inwardly of the inner side plate 12 and into the work area between the beam members 2 and 3 only a slight distance.

Figure 5:
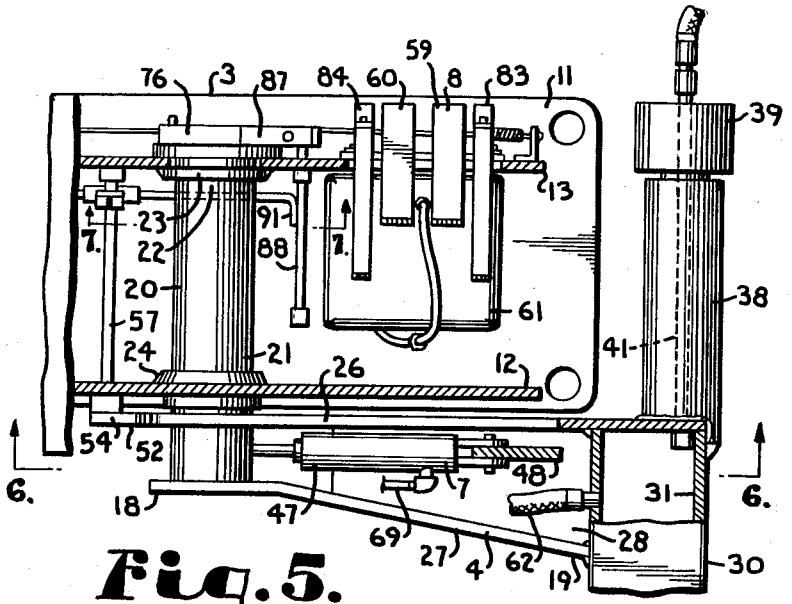
FIG. 5 is an enlarged fragmentary view showing a portion of the work rack.
Figure 8:
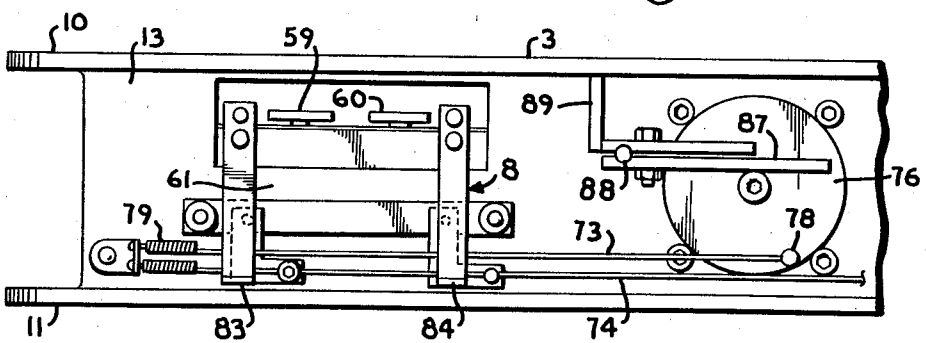
FIG. 8 is a fragmentary elevational view of the controls portion of the work rack.
Figure 7:
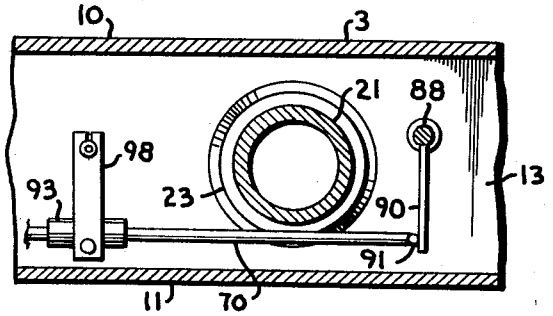
FIG. 7 is a sectional view taken along line 7—7, FIG. 5.

Each of the legs 4 or 5 consists of a flat side plate 26 mounted on the tube 21 adjacent to the inner side plate 12 and an angled side plate 27 spaced from the side plate 26 and mounted on the remote end of the rotative tube 21. A similar triangular area is formed between the side plates 26 and 27 and is generally strengthened and filled by a connecting web 28, FIGS. 5 and 6. The cross beams 6 extend between the pairs of the legs 4 and 5 and the leg lower ends 19 and provide a rigid connecting member for the rack 1. In the illustrated example, the cross beam 6 at the rack front end is a hollow box beam 30 having a hollow interior 31 providing an airtight reservoir for purposes later described. The cross beam 6 at the rear end of the work rack 1 is a pipe 33. The box beam 30 and the pipe 33 extend between the paired lower ends 19 of the respective legs 4 and 5. The rear box beam 33 has spaced wheels 34, FIG. 4, mounted therein for movement over the floor 35 and with pads 36 mounted upwardly of the wheels 34 to rest flat upon the floor 35 when the rear legs 5 are fully retracted. The cross beam 6 adjoining the front legs 4 extends laterally beyond the connection of the legs 4 with the front box beam 30. As illustrated in FIG. 5, opposite pipe ends 38 are affixed to the opposite ends of the box beam 30 and extend beyond the lower end 19 of the side plates 26. Rollers or wheels 39 are rotatably mounted to the pipe ends 38 for ease of movement over the floor 35. In one corner of the rack 1, FIG. 1, a pressurized air inlet conduit 41 extends through the wheel 39 and pipe end 38 and communicates with the interior 31 of the box beam 30 for introducing pressurized air into the interior 31, thereby using the box beam 30 as a pressurized air reservoir.

Ramps 43 fit over the pipe ends 38 by slots 44 in the shape of an inverted U and permit the ramps 43 to be removed from the rack 1 as desired. The ramps 43 are positioned in line with the respective beam members 2 and 3 so that a vehicle may be driven onto the rack 1 from the adjacent floor 35, FIG. 2, and when the vehicle is positioned on the beam members 2 and 3, the work rack 1 is raised to a level suitable for ease of working, FIG. 4. The ramps 43 are easily removable so that the workman does not tend to stumble on or trip over the ramps 43 when moving about the vehicle.

The motive means 7 forcibly rotate the legs 4 and 5 relative to the beam members 2 and 3 and are operative to raise and lower the rack 1 relative to the floor surface, FIGS. 2 and 4, and to allow the rack to tilt, FIGS. 3 and 4. In the illustrated example, the motive means 7 include hydraulic rams 47, FIGS. 5 and 6, extending between the adjacent beam member 2 or 3 and the applicable leg 4 or 5. In the illustrated example, the rams 47 are single-action hydraulic rams and are connected at one end to an ear 48 on the undersurface of the top plate 10 in the area of the inner flange 14 and a pivot pin 49 securely connected between the leg side plates 26 and 27. Each ram 47 is positioned between the side plates 26 and 27 when the legs are retracted, FIG. 2, so that the ram 47 generally nests in a recess 50 in the leg 4 or 5 formed by the side plates 26 and 27 and the web 28. This nesting arrangement permits full lowering of the rack 1 so that the bottom plates 11 of each of the beam members 2 and 3 rest upon the floor surface and so that a vehicle can be easily driven onto the rack. Four such rams 47 are used, one at each of the legs 4 or 5. The rams 47 on each of the pairs of legs 4 and 5 are connected in tandem so that they operate simultaneously.

Figure 6:
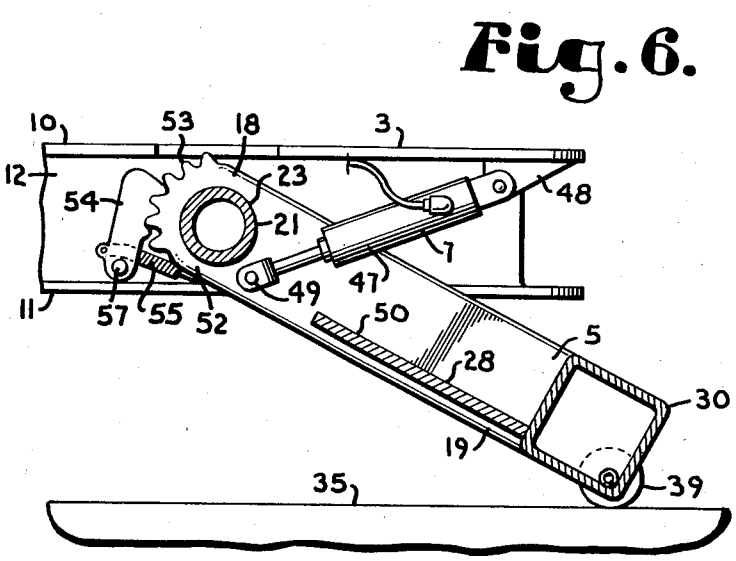
FIG. 6 is an enlarged fragmentary view taken along line 6—6, FIG. 5.

Locks 52, FIGS. 5 and 6, are provided for each of the pairs of legs 4 and 5 to positively secure the rack in the raised position, FIG. 4, or any intermediate position between fully raised and fully lowered, including tilted. In the illustrated example, the locks 52 include teeth 53, FIG. 6, formed in the leg upper end 18, and the locking dog 54 swingably mounted to the inner side plate 12 adjacent the leg upper end 18. The locking dog 54 is biased to the engaged position, FIG. 6, by a spring 55. The dog 54 is pivotally mounted on a shaft 57 which extends into the interior of the beam member 3 and is connected to various control and actuation means as described below. In the illustrated example, only those legs 4 and 5 adjacent the beam member 3 have the locks 52, for only one lock 52 on each of the front and rear pairs of legs 4 and 5 is deemed necessary.

The control and actuation means 8 is illustrated in FIG. 9. By this arrangement, hydraulic conduit lines, described below, providing fluid under pressure to the rams 47, form a linkage interconnected with the shafts 57 to move the locking dogs 54 and unlock the legs 4 and 5 relative to the beam members 2 and 3. Referring to FIGS. 5, 7, 8, 9 and 10, the control means 8 include finger lift levers 59 and 60 connected to respective valves 58 and 63, FIG. 10, to route fluid from a hydraulic fluid reservoir 61 mounted within beam member 3. A hydraulic pump (not shown) mounted within the reservoir 61 is driven by pressurized air routed into the pump through an air line 62 extending from the cross beam reservoir 31 which is in turn filled with pressurized shop air received through the conduit 41. Thus, the illustrated power means for the work rack 1 is an air over hydraulic system. Additionally, shop air to run various work tools is directed through conduit 64, FIG. 1, running along the inner flange 14 and extending to the outer flange area 15 through stub conduits 65 with quick disconnect fittings 66 dispersed at intervals about the perimeter of the work rack 1. Air for the conduit 64 is taken from the reservoir 31 through flexible lines 67.

The finger lift levers 59 and 60 act to inport fluid from the reservoir 61 to the rams 47. The actuation of the lever 59 directs fluid from the reservoir through a hydraulic line 69 to the rams 49 located on the opposite pairs of front legs 4. Actuation of the levers 60 causes fluid to be directed from the pump and reservoir 61 through rigid hydraulic conduits 70, FIG. 9, and then through a flex line 71 to the rams 49 on the rear pairs of legs 5. The rack 1 has a shut-off means to close the actuation valves when the rack has reached a full upward position, FIG. 4. In the illustrated example, the shut-off means include front and rear cables 73 and 74 respectively connected to discs 76 and 77 mounted on the ends of the rotating leg tubes 21. The cables 73 and 74 are respectively connected to a stud 78 which pull the cables 73 and 74 as the legs 4 and 5 rotate to the up position. Other ends of the cables 73 and 74 are tensioned by springs 79 and are intermediately connected to levers 80 and 81 connected to the valves 58 and 63 inporting fluid to the rams 49. When the cables 73 and 74 are pulled full out by the rotation of the discs 76 and 77 the cables simply close the respective valve to cease flow of hydraulic fluid into the ram 49.

To lower the work rack 1 and fold the legs 4 and 5 relative to the beam members 2 and 3, the outlet ports of the valves 58 and 63 are opened and the weight of the rack 1 pushes the fluid from the rams 49 and back into the reservoir 61. Lower levers 83 and 84 are connected to the out flow ports. A disengagement lever 87 is mounted adjacent to the disc 76 and rotates a shaft 88 extending through the outer side plate 13. A stop lug 89 extending from the lever 87 prevents over rotation. The shaft 88 is connected to a tang 90, FIGS. 7 and 9, positioned against the rigid hydraulic conduit 70 extending the length of the beam member 3. At its engagement with the tang 90, the conduit 70 has a right angle bend 91 and fore and aft swinging movement of the tang 90 is translated into fore and aft sliding of the conduit 70. The conduit 70 forms a linkage to swing the locking dogs 54 into and out of engagement with the teeth 53 of the locks 52. Positioned adjacent the front legs 4 and the rear legs 5 are respective collars 93 and 94 with upwardly extending tangs 95 and 96. The tangs 95 and 96 are rotatably connected to second tangs 98 and 99 which are in turn connected to the shafts 57 on which are mounted the locking dogs 54.

Rearward longitudinal sliding movement of the conduit 70, as by lifting upwardly on the lock disc engagement lever 87, causes the above linkage forming members to swing and the locking dogs 54 to swing rearwardly or up and become disengaged from the teeth 53. Note that the locking dogs 54 are biased by the springs 55 so that when pressure is released on the disengagement lever 87 the springs pull the locking dogs 54 into engagement with the teeth 53 to either lock the legs 4 and 5 at a fully extended or full up position of the rack 1 or at an intermediate level with the work rack 1 either flat or tilted toward either the front or the rear end. As the lock disengagement lever 47 is held, the levers 83 and 84 must also be held down to open the fluid out flow valves. If both are depressed, then the rack will lower evenly, however, if the lever 82 or the lever 84 are individually depressed, the according end of the rack will lower.

Figure 11:
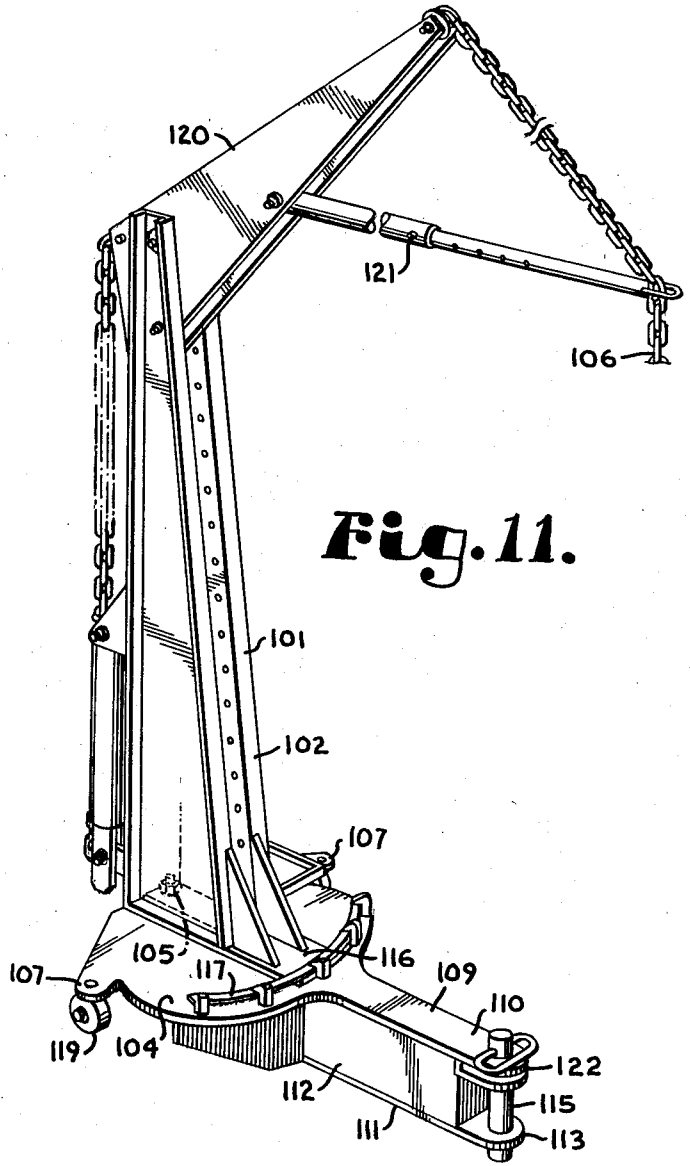
FIG. 11 is a perspective view of a force applying structure for use with the work rack.

Selectively spaced about the periphery of the rack 1 are a plurality of force applying structures 101, FIG. 11, each of which generally consists of a tower arrangement and a ram and chain configuration such as generally set forth in Eck U.S. Pat. No. 3,338,083 and termed a power post 102. Each power post 102 is swivelably mounted upon a base plate 104 by a pivot pin 105 so that the power post 102 automatically aligns itself in the direction of pull of the chain 106. The base plate 104 is generally triangular shaped and includes opposite ears 107 at the triangle apexes, each with a bore extending therethrough. The structure 101 includes a tongue 109 for connection to the work rack 1 with the tongue 109 including upper and lower plates 110 and 111 with a connecting web 112. The end of the tongue 109 is formed into a clevis 113 and a removable pin 115 is mounted in the clevis 113 for connection with the work rack 1.

As previously stated, the power post 102 is self-aligning in the direction of pull and to maintain strength while facilitating alignment, the power post 102 has a forwardly extending tang 116 captured below an arcuate railing 117. Spaced wheels 119 extend outwardly from the base plate 104 and support the structure 101 for wheeling from one location to another about the periphery of the work rack 1. In the force applying structure 101 shown in FIG. 11, the power post 102 includes an upper extension 120 and a boom 121 used to arrange the chain 106 so that a straight up pull may be effected. The upward pull is useful in pulling out roof damage or for removing parts such as an engine from the vehicle to be worked upon.

In use, the force applying structure 101 is wheeled to an appropriate position adjacent the lowered work rack 1 and the pin 115 removed and the clevis 113 of the tongue 109 inserted about the outer flange 15 of the beam members 2 and 3. The clevis 113 includes a pocket 122 into which is inserted the beam member top plate 10 and the bottom member of the clevis 113 rests upon the top surface of the bottom plate 11. Connection holes 124 extend about the periphery of the beam members 2 and 3 and are fitted with hardened bushings 125 for durability, FIG. 10. Extensible braces 127 are positioned on the structure 101 and extend between adjoining holes 124 and the ears 107 to provide lateral rigidity. The holes 124 are also positioned about the perimeter of the open interior of the rack for adaptability to various positions.

Various accessories may be provided with the work rack 1 including a removable and replaceable cross-bar 130 positionable between the beam members 2 and 3 at working height and on which may be mounted rams 131 and 132 for making pulls or pushes on damaged or bent vehicle undercarriages and for bending for alignment of beam axles, such as the front I-beam suspension of Ford trucks. Yet other cross beams 134 may be positioned across individual beam members 2 and 3, FIG. 1 and on which may be mounted rams 135 for pulling or pushing various body parts.

In use, the work rack 1 is compact, easily mobile and very versatile. It can be lowered completely to the floor surface and a vehicle may be driven on the rack 1 safely and without any problem of the vehicle falling a great distance to the floor, such as would be occasioned by pulling a vehicle onto the typical rack positioned above the floor surface on the order of three or four feet. After the vehicle is positioned on the work rack 1, it is chained down or otherwise secured against movement and the rack 1 raised to a working height, either at the full up position or any intermediate position or even in a position of fore or aft tilt. Raising or lowering the rack is accomplished by manipulation of the previous control levers in conjunction with the unlocking control lever.

When raised, the interior area between the beam members 2 and 3 is substantially free from interferring cross-pieces except for those specifically installed there by the workman for the purpose of applying force to the vehicle. In moving about the interior of the rack 1, the workman must only step over the box beams 30 and 33 of the front and rear legs 4 and 5, thereby providing a substantially open interior for complete access to the underside of the vehicle.

It is to be understood that while certain forms of the present invention have been illustrated and described herein, it is not to be limited to the specific forms or arrangement of parts described and shown.

What is claimed and desired to be secured by Letters Patent is as follows:

1. A mobile work rack arrangement for vehicles comprising:

(a) spaced, parallel, box means members respectively having front and rear ends, inner and outer webs, vehicle supportive upper plates and floor engaging lower plates, said box beam members being separated from each other their entire length to provide a substantially unobstructed elongate opening open at said front and rear ends;

(b) front and rear sets of legs having upper and lower ends and spaced inner and outer side plates with said upper ends connected to said beam members adjacent said inner webs by pivot means, said pivot means including respective outer tubes extending between and secured to said inner and outer webs in each of said box beam members, and inner tubes pivotally received in each of said outer tubes, extending therethrough and protruding inwardly with said leg upper ends secured thereto;

(c) cross beams extending laterally between opposite said front and rear sets of legs at said lower ends thereof; said cross beams generally engaging the floor, and providing structural connection and rigidity between said box beam members to substantially prevent lateral movement of said box beam members upon application of tensile force therebetween;

(d) fluid power rams pivotally mounted and extending between said box beam members and said legs and generally receivable between said leg spaced side plates; said fluid power rams being operable to swing said legs upwardly to move said box beam members against the floor and swing said legs downwardly to raise said box beam members above the floor;

(e) at least one of said legs upper ends extending beyond said pivot means and having a plurality of teeth thereon;

(f) lock means selectively engaging said teeth for locking an angular position of said legs with respect to said beam members;

(g) said box beam members having a plurality of apertures positioned about the periphery thereof and said front and rear ends; and (h) at least one force applying structure mountable to said beam members and including a base, a ram structure extending upwardly therefrom, a tongue projecting from said base and having spaced ends for pinning to said box beam member apertures and spaced side braces extending angularly outwardly from said base and pinned to said box beam member apertures, said force applying structure being movable about said beam members by removing and repositioning same on said beam members by pinning.

2. A mobile work rack arrangement for vehicles comprising:

(a) spaced, parallel beam members having front and rear ends and vehicle supportive upper plates, said beam members being separated from each other their entire lengths to provide a substantially unobstucted elongate opening open at said front and rear ends;

(b) front and rear sets of legs having upper and lower ends with said upper ends swingably mounted to said beam members by hinge means, said hinge means including paired outer tubes respectively extending across said beam members and inner tubes received within said outer tubes, extending therethrough, and protruding inwardly with said leg upper ends connected thereto;

(c) cross beams extending laterally between opposite said front and rear sets of legs at said lower ends thereof, said cross beams generally engaging the floor, and providing structural connection and rigidity between said spaced beam members to substantially prevent lateral movement of said beam members upon application of tensile force therebetween;

(d) motive means extending between said beam members and said legs;

(e) said motive means providing upward swinging of said legs into a retracted position with said beam members resting substantially upon a floor surface and downward swinging of said legs into an extended position with said beam members positioned above said floor surface;

(f) control means connected to said motive means and operable to regulate movement of same;

(g) at least one force applying structure mounted on at least one of said beam members, and having tensile means connected thereto for applying tensile force to a vehicle supported on said beam members, said cross beams resisting the force of said force applying structure tending to pull said beam members together.

3. A mobile work rack arrangement for vehicles comprising:

(a) spaced, parallel box beam members respectively having front and rear ends, inner and outer webs, vehicle supportive upper plates and floor engaging lower plates, said box beam members being separated from each other their entire lengths to provide an unobstructed elongate opening open at said fron and rear ends;

(b) front and rear sets of legs having upper and lower ends with said upper ends swingably mounted to said box beam members adjacent said inner webs by hinge means; said hinge means including a respective outer tube extending between and secured to said inner and outer webs in each of said box beam members, and an inner tube received snugly within said outer tube, extending therethrough, and protruding inwardly with said leg upper ends connected thereto;

(c) said legs having spaced members retaining a space therebetween;

(d) cross beams extending laterally between opposite said front and rear sets of legs at said lower ends thereof; said cross beams generally engaging the floor, and providing structural connection and rigidity between said spaced box beam members to substantially prevent lateral movement of said box beam members upon application of tensile force therebetween;

(e) fluid power rams extending between said box beam members and said legs and generally positioned within said leg spaced side members; said fluid power rams being retractable to swing said legs upwardly to generally rest said box beam members upon the floor and with said power fluid rams received between said spaced side members, and being extensible to swing said legs downwardly and raise said box beam members above the floor;

(f) control means connected to said fluid power rams and operable to regulate movement of same; and (g) at least one force applying structure mounted on at least one of said box beam members, and having tensile means connected thereto for applying tensile force to a vehicle supported on said box beam members, said cross beams resisting the force of said force applying structure tending to pull said box beam members together.

4. A mobile work rack arrangement for vehicles comprising:

(a) beam members having front and rear ends and vehicle supportive upper plates;

(b) front and rear sets of legs having upper and lower ends;

(c) said legs upper ends swingably mounted to said beam members by hinge means including pivots mounted in said beam members; said legs lower ends respectively connected to cross beams extending laterally between opposite said front and rear sets of legs;

(d) said legs upper ends ending beyond said pivots and having a plurality of teeth therein;

(e) lock means selectively engaging said teeth for locking an angular position of said legs with respect to said beam members;

(f) motive means providing upward swinging of said legs into a retracted position with said beam members resting substantially upon a floor surface and downward swinging of said legs into an extended position with said beam members positioned above said floor surface;

(g) control means connected to said motive means and operable to regulate movement of same;

(h) at least one force applying structure mounted on at least one of said beam members, and having tensile means therewith for applying tensile force to a vehicle supported on said beam members.

5. A mobile work rack arrangement for vehicles comprising:

(a) spaced, parallel beam members having front and rear ends, inner and outer sides, and vehicles supportive upper plates, said beam members being separated from each other their entire lengths to provide a substantially unobstructed elongate opening open at said front and rear ends;

(b) front and rear sets of legs having upper and lower ends and spaced inner and outer side plates with said upper ends connected to said beam members by hinge means, said hinge means including pivots across each of said beam members from said outer to said inner sides and terminating short of said elongate opening;

(c) cross beams extending laterally between opposite said front and rear sets of legs at said lower ends thereof; said cross beams generally engaging the floor, and providing structural connection and rigidity between said spaced beam members to substantially prevent lateral movement of said beam to members upon application of tensile force therebetween;

(d) fluid power rams extending between said beam members and said legs; said rams swinging said legs upwardly to generally rest said beam members upon the floor and swinging said legs downwardly to raise said beam members above the floor;

(e) said beam members having a plurality of apertures positioned about the periphery of said beam members and said front and rear ends; and (f) a force applying structure mountable to said beam members and including a base, a ram structure extending upwardly therefrom, a tongue extending outwardly from said base and having spaced ends for pinning to said beam members apertures and spaced side braces extending angularly outwardly from said base and pinned to said beam members apertures, said force applying structure being movable about said beam members by removing and repositioning said force applying structure on said beam members by pinning same thereto.

* * * * *